US007918677B2

(12) United States Patent
Robert

(10) Patent No.: US 7,918,677 B2
(45) Date of Patent: Apr. 5, 2011

(54) FEMALE CONNECTOR FOR SELF-LOCKING CONNECTOR SYSTEM

(75) Inventor: David Robert, Montbenoit (FR)

(73) Assignee: Interlemo Holding S.A., Ecublens (CH)

( * ) Notice: Subject to any disclaimer, the term of this patent is extended or adjusted under 35 U.S.C. 154(b) by 333 days.

(21) Appl. No.: 12/170,879

(22) Filed: Jul. 10, 2008

(65) Prior Publication Data

US 2009/0304334 A1 Dec. 10, 2009

(30) Foreign Application Priority Data

Jun. 9, 2008 (EP) ..... 08157878

(51) Int. Cl.
*H01R 13/62* (2006.01)

(52) U.S. Cl. ..... 439/317; 439/348

(58) Field of Classification Search ..... 439/317, 439/348

See application file for complete search history.

(56) References Cited

U.S. PATENT DOCUMENTS

| | | | | |
|---|---|---|---|---|
| 5,803,750 | A * | 9/1998 | Purington et al. | 439/348 |
| 6,227,895 | B1 * | 5/2001 | Mc Farlane | 439/352 |
| 6,749,454 | B2 | 6/2004 | Schmidt et al. | |
| 6,893,284 | B1 * | 5/2005 | Fawcett et al. | 439/348 |
| 7,040,909 | B2 * | 5/2006 | Cairns | 439/271 |
| 7,364,450 | B2 | 4/2008 | Hafner et al. | |
| 7,568,934 | B1 * | 8/2009 | Williams et al. | 439/271 |

FOREIGN PATENT DOCUMENTS

| | | | |
|---|---|---|---|
| DE | 20 2005 016 989 | U1 | 2/2006 |
| EP | 0 187 887 | A | 7/1986 |
| EP | 0 901 194 | A | 3/1999 |
| EP | 1 311 035 | A | 5/2003 |
| EP | 1 626 463 | A | 2/2006 |

OTHER PUBLICATIONS

Search Report published by European Patent Office on Nov. 19, 2008 for priority European application 08157979.3.

* cited by examiner

*Primary Examiner* — Tho D Ta
(74) *Attorney, Agent, or Firm* — Frommer Lawrence & Haug LLP; Ronald R. Santucci

(57) ABSTRACT

The invention relates to a female connector (1) for a connector system (2) that couples first and second signal transmission conductor means. The connector system comprises a self-locking system of the push-pull type, some elements of which are secured to the female connector (1). The female connector (1) comprises a tubular body (10) housing an insert (11) equipped to accept each of the ends of the first signal conducting means. The elements (12) of the self-locking system that are secured to the female connector are formed on said insert (11). The invention also relates to a male connector (3).

8 Claims, 2 Drawing Sheets

FEMALE CONNECTOR FOR SELF-LOCKING CONNECTOR SYSTEM

This application claims priority benefits from European Patent Application No. 08157878.3 filed Jun. 9, 2008, the disclosure of which is hereby incorporated by reference.

BACKGROUND OF THE INVENTION

The present invention relates to a female connector for a connector system that couples first and second signal transmission conductor means, said connector system comprising a self-locking system of the push-pull type, some elements of which are secured to the female connector, said female connector comprising a tubular body housing an insert equipped to accept each of the ends of the first signal conducting means and connect them with the ends of the second signal conducting means. The invention also relates to a male connector that is the conjugate of the female connector and to a self-locking connector system formed by the aforementioned male and female connectors.

DESCRIPTION OF THE PRIOR ART

Self-locking connectors of the push-pull type for coupling signal transmission conductors have been known for a number of years. These connectors comprise a female connector more commonly known as a socket essentially comprising a sleeve housing an insert equipped to accept each of the ends of the conductors and a male connector more commonly known as a plug. The surface of the tubular body of the socket is often equipped with openings or blind holes that form part of the locking system. The plug comprises an inner sleeve housing an insert similar to the insert of the socket and a locking system comprising elastic tabs equipped with locking profiles that complement the openings or blind holes in the tubular body of the socket. An operating sleeve is mounted such that it can move on the inner sleeve of the plug and is equipped with means that allow the tabs to be pushed against the elastic thrust and allow the assembly to be unlocked. The shapes and arrangements of the various means that collaborate to achieve locking and unlocking vary. The fact that there are openings or blind holes in the wall of the tubular body of the socket weakens the wall and compromises the sealing that is required in various fields in which these self-locking connectors are used, even if only in the medical field.

SUMMARY OF THE INVENTION

The present invention provides a solution to this problem and namely proposes a female connector or socket of a push-pull connector the outer tubular body of which is perfectly sealed and is not weakened by the presence of locking means particularly when the socket is of small size and the wall thickness is small.

The invention also proposes a corresponding male connector or plug and the self-locking connector obtained by the collaboration of these two, male and female, connectors.

The female connector or socket is defined by the characterizing part of claim 1.

The fact that the elements of the self-locking system that are secured to the socket are formed on the insert means that the tubular body of the socket is not weakened and above all means that this socket can be sealed.

In an alternative form, said elements of the self-locking system consist of at least two, positive or negative or alternating, reliefs located on the periphery of said insert.

Specifically, the use of at least two positive reliefs (protrusions) or negative reliefs (recesses) or alternating reliefs on the lateral walls of the insert means that locking can be achieved with a plug that has complementary means without weakening the tubular body of the socket, thereby allowing a good seal to be obtained. The reliefs will have a profile that facilitates engagement with the complementary elements of the plug and prevents unwanted unlocking.

The insert may be made as one piece with the tubular body of the socket, for example, if the tubular body and the insert are made of an insulating material, the entire entity being obtained by injection-molding.

The invention also relates to a male connector or plug intended to collaborate with a female connector or socket to form a connector system, and which comprises a first tubular body housing an insert equipped to accept each of the ends of the second signal conducting means, said tubular body being extended axially by at least two elastic tab means provided with locking means that are the conjugate of said elements of the self-locking system sited on said insert of the female connector, a second tubular body mounted such that it can slide on said first body and equipped with means for pushing said locking means against the elastic force of said tab means.

Finally, the invention also relates to a connector system for coupling the first and second signal transmission conductor means, said connector system comprising a female connector as defined in one of claims 1 to 3 and a male connector as defined in claim 4.

DESCRIPTION OF THE DRAWINGS

The invention will be described in greater detail with the aid of the attached drawing.

DESCRIPTION OF THE PREFERRED EMBODIMENT(S)

Figure 1:
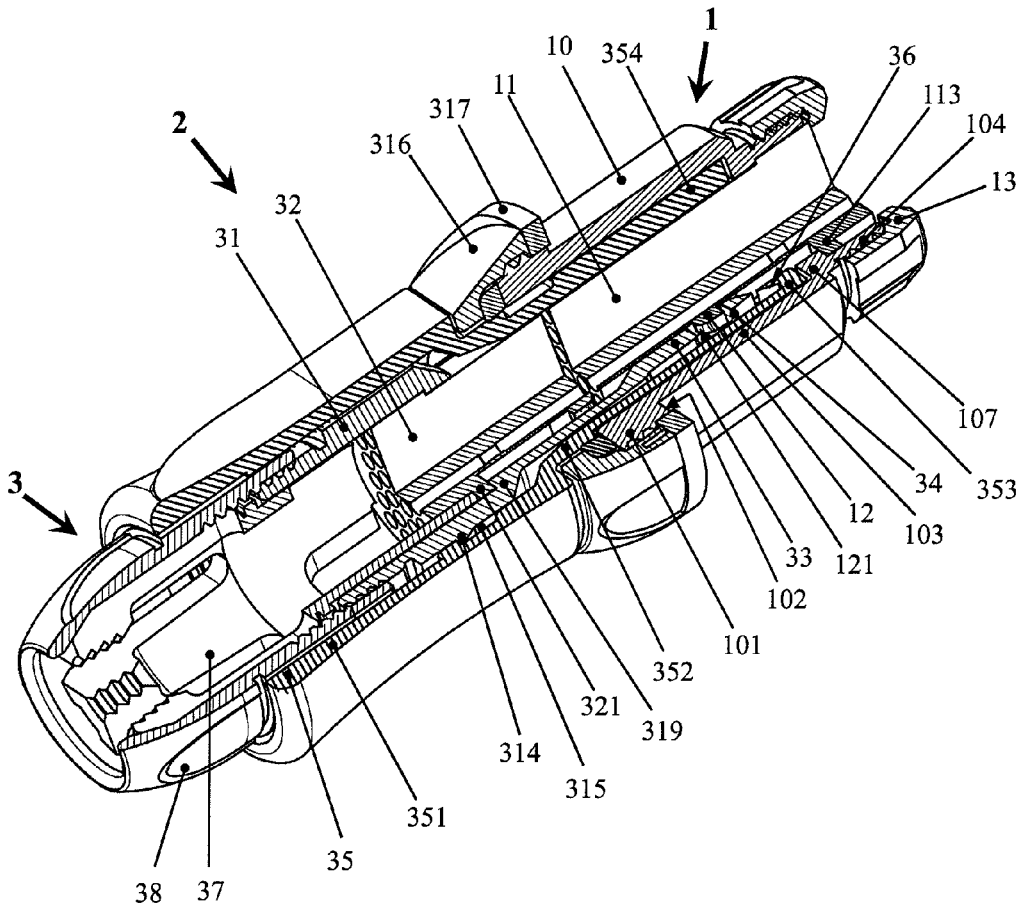
FIG. 1 is a perspective view of a connector system with cutaway along two axial planes.

In FIG. 1, a connector system 2 which couples the first and second conductor means is depicted in perspective with cutaway along two axial planes. It comprises a socket (female connector) 1 and a plug (male connector) 3.

Figure 2:
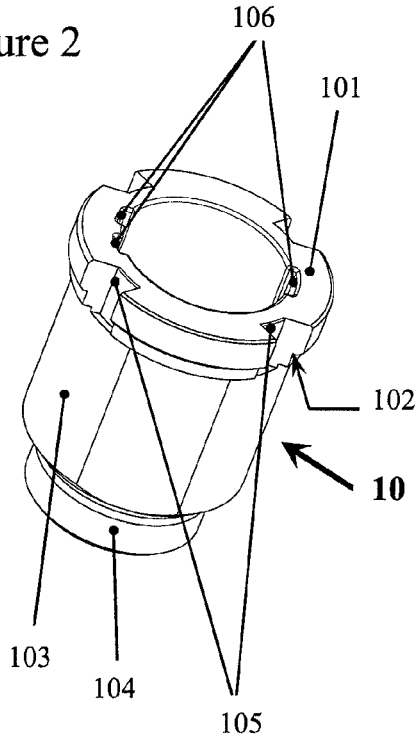
FIG. 2 is a perspective view of the tubular body of the socket.

The socket 1 comprises a tubular body 10 (see also FIG. 2) comprising a threaded collar 101 ending in a shoulder 102, a main part 103 and a threaded part 104. Four notches 105 are provided on the threaded collar 101 and three longitudinal cuts 106 are provided inside the tubular body 10. An insert 11 is housed inside the tubular body 10. The insert 11 is intended to house the ends of the first conducting means. It is in theory made of an insulating material and has passing through it axially channels in which conducting sleeves are housed and the sleeves are connected to the ends of the conducting means. A nut 13 screwed onto the threaded part 104 of the body 10 holds the insert 11 inside the tubular body 10 while two shoulders 107 of the tubular body 10 and 113 of the insert 11 butt against one another and prevent the insert 11 from shifting. The insert 11 has two reliefs or bulges 12 (only one is depicted in FIG. 1). The relief 12 has a ramp 121 on the part facing towards the plug 3.

The plug 3 comprises a first tubular body 31 (see also FIG. 3) equipped with a threaded part 311, and two annular ribs (segments) 314. The tubular body 31 is extended axially by two elastic tabs 33. These two tabs are each equipped with a hole 34 and their free end has a ramp 312.

Figure 4:
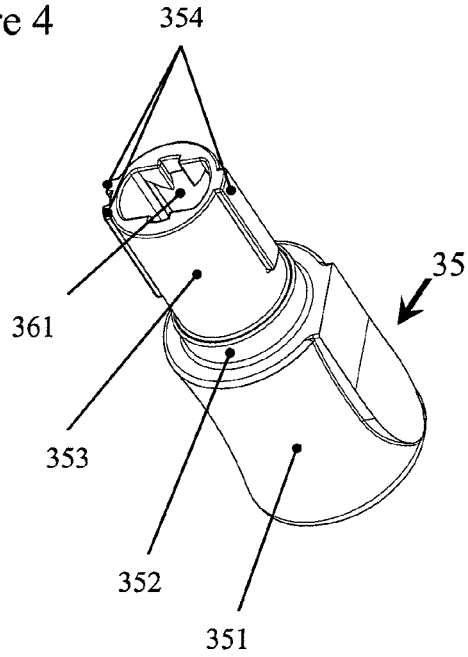
FIG. 4 is a perspective view of the second tubular body of the plug.

The plug 3 comprises a second tubular body 35 (see also FIG. 4) containing the first tubular body 31. The tubular body 35 comprises a first part 351 of larger diameter followed by a smaller-diameter cylindrical bearing surface 352 and a third cylindrical part 353. The end of the part 353 has a shape that is the conjugate of the insert 11 of the socket 1 and extends over a short length. This latter part is followed by two axial recesses 361 corresponding to the shape and width of the elastic tabs 33 of the tubular body 31. The end of these two recesses 361 has a ramp 36 that is the conjugate of the ramps 312 of the body 31. The two annular ribs 314 of the first tubular body 31 enter two corresponding annular recesses 315 situated in the inner part of the second tubular body 35 so as to limit the relative axial movement of the first and second tubular bodies 31 and 35 relative to one another. The cylindrical part 353 is equipped on its lateral surface and over its entire length with three axial ribs 354 intended to collaborate with the cuts 106 in the cylindrical body 10 of the socket 1.

A ring 316 is screwed onto the threaded collar 101 of the cylindrical body 10 of the socket 1. It is fitted with a sealing gasket 317. Said gasket has four ribs (not depicted) collaborating with the notches 105 of the tubular body 10 of the socket 1 in order on the one hand to provide sealing between the socket 1 and the plug 3 (upon plugging-in) and also to seal the socket 1 at the panel on which it is fitted.

An insert 32 is housed inside the tubular body 31. It is kept pressed against an internal shoulder 319 of the tubular body 31 via a shoulder 321 against which a clamp 37 bears, this clamping action being provided axially by a clamping nut 38 screwed onto the threaded part 311 of the first tubular body 31.

The self-locking of the connector system 2 is achieved by pushing the plug into the socket in such a way that the axial ribs 354 are indexed and slide in the cuts 106. When the ramps 312 at the ends of the elastic tabs 33 begin to press against the ramps 121 of the reliefs 12 they part, deforming elastically until the reliefs 12 have entered the holes 34. In this position, the assembly is locked and any pulling on its two ends, be this via the cables, via the clamping nut 38 or via the nut 13, will not unlock it.

To unlock the connector system 2 it is necessary to pull the tubular body 35 of the plug axially while holding the ring 316 in the other hand. Under the effect of this pulling, the body 35 moves and the collaboration between the ramps 36 and 312 has the effect of moving the elastic tabs 33 radially, thus unlocking the assembly. The axial movement of the body 35 is limited by the height of two annular recesses 315. When the plug and the socket are no longer plugged together, the body 35 returns to the rest position under the thrust of the elastic tabs and the collaboration between the ramps 312 and 36.

Figure 3:
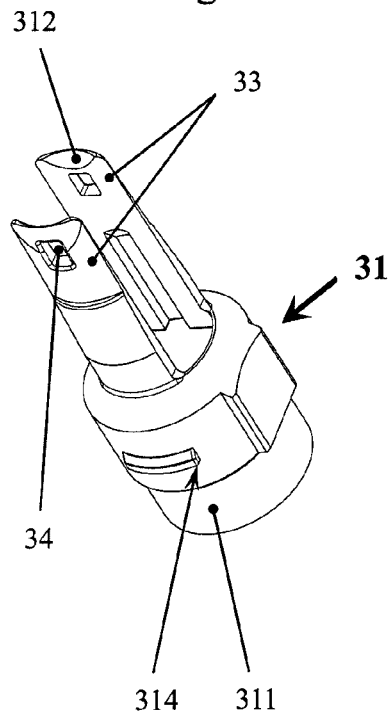
FIG. 3 is a perspective view of the first tubular body of the plug.

It is obvious that the number of reliefs 12 and elastic tabs 33 can vary according to the dimensions of the socket and of the plug. Likewise, the reliefs 12 may be positive as depicted in FIGS. 1 and 3 or negative, and in this case the holes 34 in the tabs 33 will be replaced by corresponding positive reliefs. It is also possible to alternate positive and negative reliefs on the insert 11, taking care to do likewise with the corresponding tabs.

Finally, the insert 11 could be made as one piece with the tubular body 10 of the socket 1, especially if it is made of an insulating material.

It is possible to modify the various elements described hereinabove by way of example while at the same time complying with the intended objective of the present invention, that is to say of having the insert, rather than the tubular body of the socket, performing the locking.

The invention claimed is:

1. A female connector for a connector system that couples first and second signal transmission conductor means, said connector system comprising a self-locking system of the push-pull type, allowing the locking and unlocking of the connector system, some elements of which are secured to the female connector, said female connector comprising a tubular body housing an insert equipped to accept each of the ends of the first signal conducting means and connect them with the ends of the second signal conducting means, wherein said elements of the self-locking system that are secured to the female connector are formed on said insert and wherein said tubular body is sealed and said insert is mounted into said tubular body so said insert cannot be moved.

2. The female connector as claimed in claim 1, wherein said elements of the self-locking system consist of at least two, positive or negative or alternating, reliefs located on the periphery of said insert.

3. The female connector as claimed in claim 1, wherein said insert is made as one piece with said tubular body.

4. A male connector intended to collaborate with a female connector as claimed in any one of claims 1, 2 and 3 and to form said connector system, and which comprises a first tubular body housing an insert equipped to accept each of the ends of the second signal conducting means, said first tubular body being extended axially by at least two elastic tab means provided with locking means that are the conjugate of said elements of the self-locking system sited on said insert of the female connector, a second tubular body mounted such that it can slide on said first body and equipped with means for pushing said locking means against the elastic force of said tab means.

5. A connector system for coupling the first and second signal transmission conductor means, said connector system comprising a female connector and a male connector as defined in claim 4.

6. The female connector as claimed in claim 2, wherein said insert is made as one piece with said tubular body.

7. A male connector intended to collaborate with a female connector as claimed in claim 2 and to form said connector system, and which comprises a first tubular body housing an insert equipped to accept each of the ends of the second signal conducting means, said first tubular body being extended axially by at least two elastic tab means provided with locking means that are the conjugate of said elements of the self-locking system sited on said insert of the female connector, a second tubular body mounted such that it can slide on said first body and equipped with means for pushing said locking means against the elastic force of said tab means.

8. A male connector intended to collaborate with a female connector as claimed in claim 3 and to form said connector system, and which comprises a first tubular body housing an insert equipped to accept each of the ends of the second signal conducting means, said first tubular body being extended axially by at least two elastic tab means provided with locking means that are the conjugate of said elements of the self-locking system sited on said insert of the female connector, a second tubular body mounted such that it can slide on said first body and equipped with means for pushing said locking means against the elastic force of said tab means.

* * * * *